United States Patent [19]

Schiele et al.

[11] Patent Number: 4,481,860

[45] Date of Patent: Nov. 13, 1984

[54] CARTRIDGE MAGAZINE FOR CANNON MOUNTED IN TANK TURRETS, ESPECIALLY ARMORED CAR TURRETS

[75] Inventors: August Schiele; Wolfgang Huber, both of Augsburg, Fed. Rep. of Germany

[73] Assignee: Firma Keller and Knappich Wehrtechnik GmbH, Fed. Rep. of Germany

[21] Appl. No.: 294,996

[22] Filed: Aug. 19, 1981

[30] Foreign Application Priority Data

Aug. 19, 1980 [DE] Fed. Rep. of Germany ..... 3031202

[51] Int. Cl.[3] ..... F41F 9/06

[52] U.S. Cl. ..... 89/34; 89/36 K; 198/800

[58] Field of Search ..... 89/33 BB, 33 BC, 34, 89/36 K, 45; 198/799, 800

[56] References Cited

U.S. PATENT DOCUMENTS 3,447,666 6/1969 Nevo-Hacohen ..... 198/800

3,724,324 4/1973 Zielinski ..... 89/34

*Primary Examiner*—Stephen C. Bentley

*Attorney, Agent, or Firm*—McGlew and Tuttle

[57] ABSTRACT

A cartridge magazine comprising tubular containers each equipped for the pickup and feed of one cartridge case, these containers being in parallel to each other and aligned with the bore axis of the cannon barrel. The containers are on an endless track revolving in mutually superposed horizontal planes and the tubular containers on both of their faces are linked to conveyor chains carried in guide rails by means of a trunnion, and are guided in additional magazine fixed guide rails, of which one is restricted, to an endless-trackless deflecting section, by means of two pilots attached to each container outside the circular track of this trunnion to the effect of maintaining a constantly positioned rotation of the containers.

3 Claims, 4 Drawing Figures

CARTRIDGE MAGAZINE FOR CANNON MOUNTED IN TANK TURRETS, ESPECIALLY ARMORED CAR TURRETS

FIELD AND BACKGROUND OF THE INVENTION

The present invention relates to a cartridge magazine for cannon mounted in tank turrets, and especially for armored car turrets, comprising tubular containers each for the pickup and feed of one cartridge case, these containers being in parallel to each other and aligned with the bore axis of the cannon barrel. The containers are disposed behind the cannon on an endless track revolving in mutually superposed horizontal planes across the bore axis, and the tubular containers on both of their faces are linked to conveyor chains carried in guide rails by means of a trunnion, and are guided in additional magazine fixed guide rails, of which one is restricted, to an endless-track deflecting section, by means of two pilots attached to each container outside the circular track of this trunnion to the effect of maintaining a constantly positioned rotation of the containers.

With a known construction of this type (see U.S. Pat. No. 3,724,324) both pilots are disposed at equidistant spacings from the trunnion and are located on a container peripheral chordal section, which runs on the train of the horizontal guide rail sections. The result is that on its deflecting point the guide rail must be double-tracked. This requires a type of point control, which interrupts a uniform, vibration-and-breakdown free drive. Ammunition mounting requirements for cross-country type armored vehicles are thus only partly met. Moreover, on the synchronous run-through of the deflection apex of both guide rails, both pilots cannot produce any counter-effective holdup against vertical hits and impact shocks.

SUMMARY OF THE INVENTION

Based on above-enumerated state-of-the-art drawbacks, the object of the present invention is to improve on these cartridge containers in such a way that a uniformly safe guidance of cartridge containers is assured constantly and over the entire revolving range so that even on driving over extremely bumpy territory the conveyor chain drive operates in a trouble free way.

This problem is solved according to the invention in that both pilots are disposed at variously distant spacings from the trunnion, and that for the pilot set at the farthest distance, there are provided at the endless track deflecting area, separate secondary guide rail sections having feed throats on both of their ends.

According to the invention only the pilot closest to the trunnion in its assigned guide rail is provided with a constant guidance over the entire endless-closed loop. This guide rail, therefore, can do without any point control so that it can provide an all around uniform guide. In interaction with the trunnion of the container linkage to the conveyor chains, such a single guide by pilot means in a guide rail is completely sufficient at least over the horizontally run segmental path. In the endless-track deflecting area provisions are made for separate secondary guide rail segments, which because of the extended spacing between pilots being carried in them, assume a complete independence from the endless-looped guide rail. The spatial disposition of these secondary guide rail sections is such that any unexpected hit or blow to the pilot carried in the endless-looped guide rail, while this pilot passes the apex of the track deflection in the vertical tangent thereof, will be absorbed. Another pilot of each container passes into the separate guide rail segments and thus a three-point container guidance is established. These guide flanks thus intercept the aforementioned blow. This is due to the U-shaped guide rail profile.

These pilots run along emptily over the horizontal guide areas, i.e., in an unguided way. For an easy and safe feed into their assigned guide rail segments the latter have feed throats disposed on both of their ends.

In this case it is of advantage also that the pilot set closest to the trunnion is set outward from the container, which, e.g., can be implemented by a fixed arm. This frees both container faces; the loading of the cannon and the charging of the container with a new cartridge case proceeds unobstructed.

BRIEF DESCRIPTION OF THE DRAWINGS

An embodiment of the invention is illustrated in the attached drawings, wherein;

FIGS. 1 and 2 show the rear area of a tank turret 1, which is pivotable around a vertical-axial line A—A. Supported in turret 1 is a cannon 2, which can be aimed upwardly around a trunnion-axial line B—B. The loading of cannon 2 with a cartridge case 3 is done from a tubular container 5 via a loading ramp 4, the container being part of a magazine 8 revolving on the endless path 6 of a chain pair across the bore axis 7 of cannon 2. In this case that container 5, from which the loading is made, is disposed at the bottom end of endless path 6 in a position aligned with the bore axis 7 of cannon 2. For this purpose the cannon 2 is swiveled into zero elevation position shown in FIGS. 1 and 2.

At this alignment angle the partition wall 9, which separates the magazine 8 from the rest of the tank turret space, has a hole for the passage of a cartridge. Revolutions of the magazine 8 along conveyor chain path 6 can be powered by a motor 10 or under emergency conditions also can be manually moved.

Figure 1:
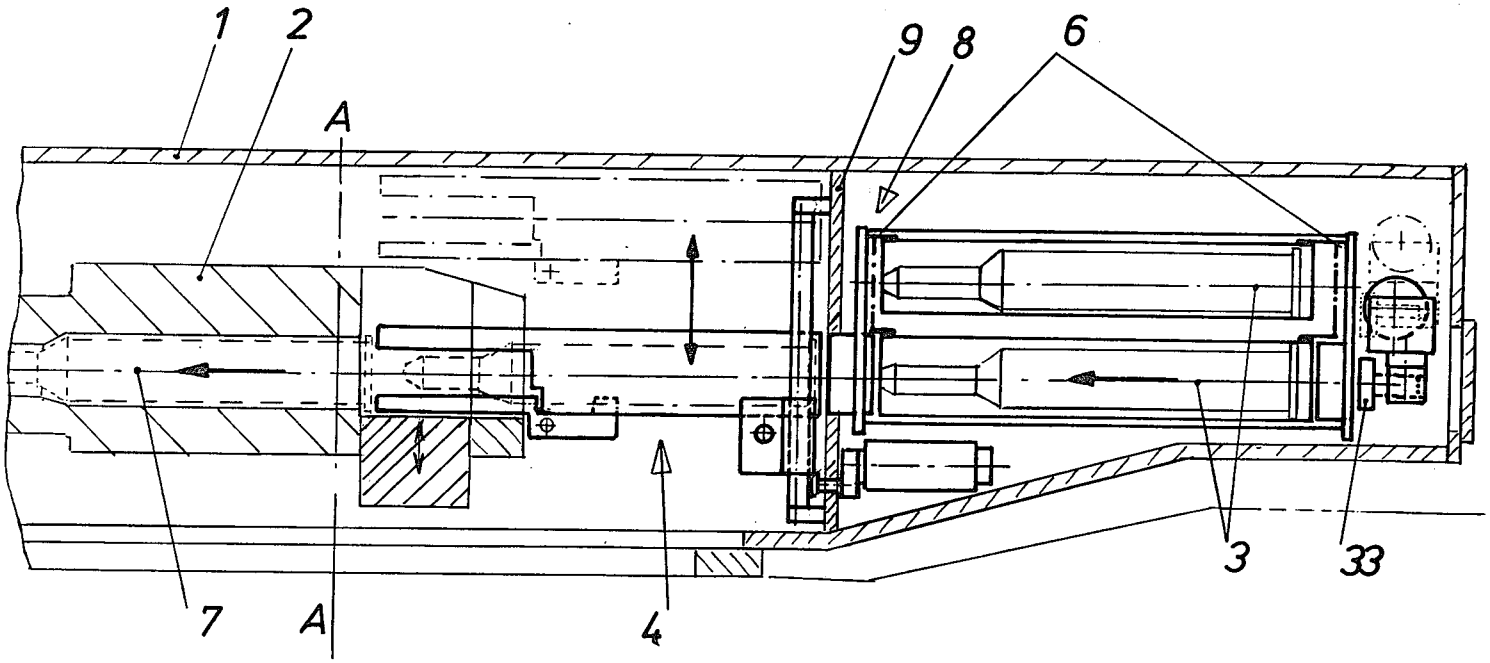
FIG. 1 is a longitudinal vertical section of a tank turret rear area with magazine.
Figure 2:
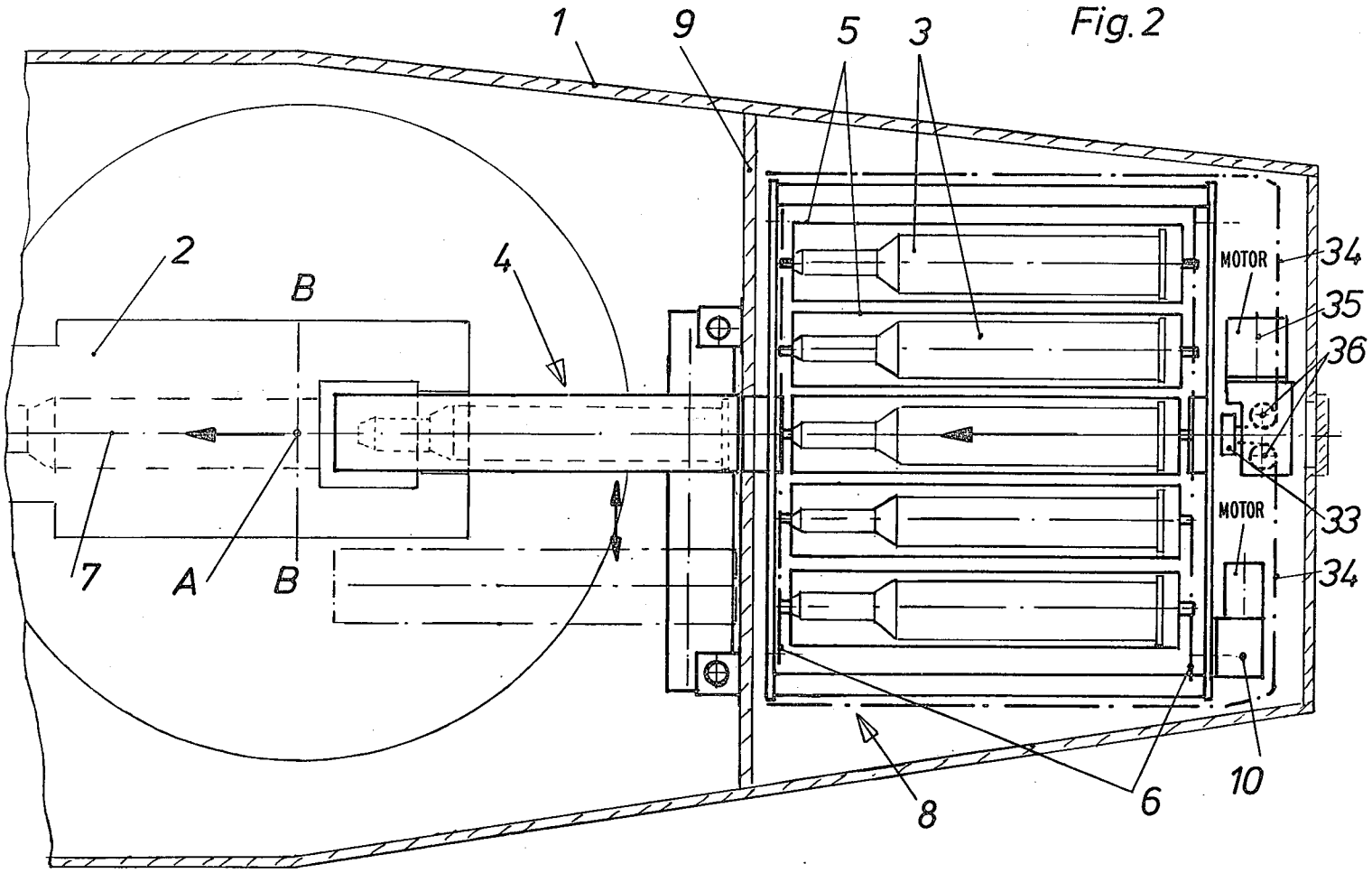
FIG. 2 is a top view of FIG. 1.
Figure 3:
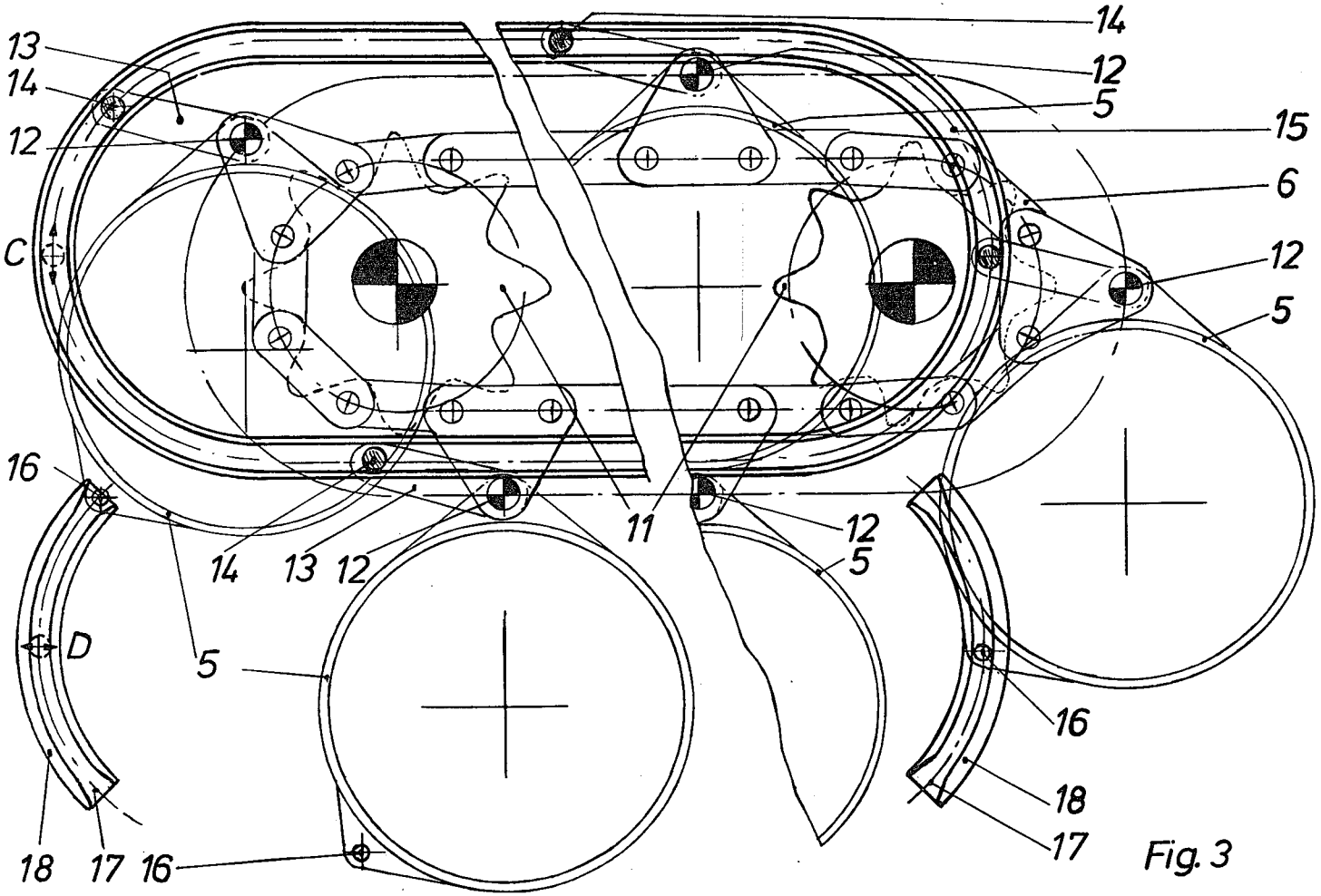
FIG. 3 is a vertically cut rear view of the magazine at an enlarged scale.

In FIG. 3 the guidance of chain path 6 around both of its deflecting wheels or sprockets 11, of which one has a drive, is clearly visible. The chains are carried in guide rails, which are not shown. Special purpose chain members carry the containers 5 on pivot pins or trunnions 12. To prevent any free swinging of containers 5 on these trunnions 12 a slightly outwardly projecting arm 13 is attached to the container. This arm carries a pilot 14, which laterally projects into magazine 8 and into guide rails 15 having a horizontal U-profile. These rails 15 form an endless-looped track, which relative to the chain path 6 is so positioned that the arms 13 assume the same solid-angular position at all times, which maintains also the containers 5 at a constant-revolving position. Thus the containers 5 are carried through at a sufficient margin of safety and uniformity at least on a run-through of both horizontally planar superposed path segments. The pilots 14 are held in a tensional direction by the stretched chain and are vertically tensioned by the horizontal U-profiled flanks of guide rail 15, between which the pilot 14 runs.

These guides are maintained also in the deflecting or turning area of the endless-looped tracks 6 and 15. However, at this point the perpendicular-spaced guidance function weakens, and reaches its weakest point, where it becomes tangent to the deflection apex, as indicated in FIG. 3 at C. Assuming there is a certain play in movement which is unavoidable, then any vertically produced blow or impact shock cannot be compensated for at this spot. Therefore, on container 5 a secondary pilot 16 is provided at a considerable distance from the trunnion 12. Upon movement of pilot 14 into the deflecting area of guide rail 15 the pilot 16 moves into a magazine 8-disposed guide rail segment 18 via a feed throat or channel 17. Thus a deflecting area timed, three-point guidance is effective at 12, 14, and 16. As indicated in FIG. 3 at the point D (to be assumed by pilot 16 in case pilot 14 in guide rail 15 is set at C) a blow from a perpendicular-spatial direction at C via the effective lever arms on the three points rigidly interconnected on container 5 has the result of a blow in a horizontal-spatial direction at D to be intercepted by the guide rail segment 18. This guide segment is bilaterally provided on the right and left. There is a feed channel 17 on both ends so that any given revolving direction can be used.

Figure 4:
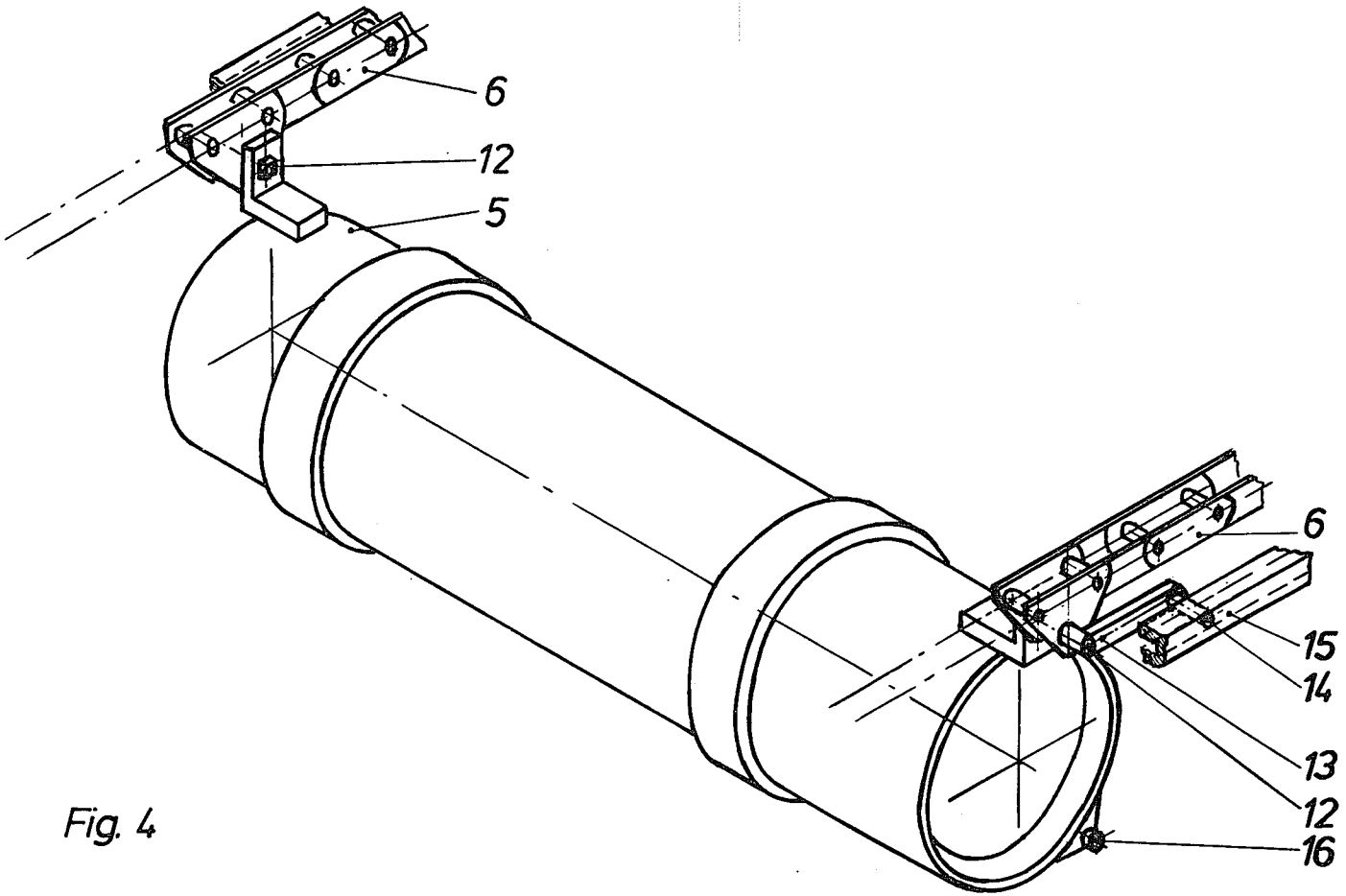
FIG. 4 is a perspective view of a magazine container.

The perspective view of FIG. 4 shows the offset of chain path 6 and guide rail 15 being staggered in the direction of the longitudinal axis of container 5.

The invention represents a key improvement of a subassembly for an automatic loading device for large-caliber ammunition. To load the cannon 2 via the loading ramp 4 a cartridge case 3 is pushed out of the container 5 by a ram 33. For this purpose the ram 33 is moved by a pair of rigid chains 34 in turn being actuated by a motor 35 or under emergency conditions by manually operated deflecting rollers 36.

We claim:

1. A cartridge magazine for the cannon of an armored vehicle turret, the cannon having a bore axis and a "zero" elevation position, the cartridge magazine comprising:

a plurality of tubular cartridge containers having axes which are parallel to each other and parallel to the bore axis of the cannon, with the cannon in the "zero" elevation position, said plurality of cartridge containers moving in an endless patten having two superimposed parallel planes, one plane extending across the bore axis with the cannon in the "zero" elevation position;

a first endless conveyor chain having a first plurality of trunnions each connected to one of said containers at one end of each container for moving said containers in said endless pattern;

a second endless conveyor chain having a second plurality of trunnions each connected to one of said containers at an opposite end of each container for moving said containers in said endless pattern;

drive means connected to said first and second endless conveyor chains for driving said first and second endless conveyor chains to move said plurality of containers in said endless pattern;

at least one endless guide rail disposed at a location spaced from the path of movement of each of said first and second plurality of trunnions;

a first pilot connected to each container adjacent one end thereof and at a first spaced location from each of said first plurality of trunnions, each of said first pilots riding in said guide rail;

a second pilot connected to each of said containers at said one end thereof at a second spaced location from each of said first plurality of trunnions which is greater than said first spaced location;

said guide rail having a pair of opposite end deflection areas at which containers move from one of said horizontal planes to the other; and a secondary open guide rail adjacent each of said end deflection areas for receiving each of said second pilots in succession as a container carrying each second pilot moves past one of said deflection areas, each secondary open guide rail having a throat at each end thereof for receiving and discharging each of said second pilots in succession.

2. A cartridge magazine according to claim 1, including an arm connected between each of said first plurality of trunnions and each first pilot, each of said first and second plurality of trunnions pivotally mounting a container to each of said first and second endless conveyor chains respectively, and each arm non-rotatably connected to each container respectively so that said arms and first pilots keep each container from rocking between each of said opposite end deflection areas and, at said opposite end deflection areas, said arms, said first pivots and said second pivots keep each container from rocking.

3. A cartridge magazine according to claim 2, wherein said endless guide rail is semi-circular in each of said opposite end deflection areas, each of said secondary open guide rails being curved and disposed below each of said opposite end deflection areas respectively.

* * * * *

UNITED STATES PATENT OFFICE

CERTIFICATE OF CORRECTION

Patent No. 4,481,860 Dated Nov. 13, 1984

Inventor(s) Schiele et al

It is certified that error appears in the above-identified patent and that said Letters Patent are hereby corrected as shown below:

On the title page;

The name of the Assignee is hereby corrected to appear as follows:

KUKA Wehrtechnik GmbH

Signed and Sealed this

*Thirtieth* Day of *July 1985*

[SEAL]

*Attest:*

DONALD J. QUIGG

*Attesting Officer* *Acting Commissioner of Patents and Trademarks*